United States Patent [19]

Paradis

[11] 4,264,012

[45] Apr. 28, 1981

[54] SEGREGATION OF MOLDED PARTS

[75] Inventor: Joseph R. Paradis, Holden, Mass.

[73] Assignee: Automated Assemblies Corp., Clinton, Mass.

[21] Appl. No.: 80,212

[22] Filed: Oct. 1, 1979

[51] Int. Cl.[3] ..... B07B 13/05

[52] U.S. Cl. ..... 209/664

[58] Field of Search ..... 209/669, 670, 667, 668, 209/664, 662, 362; 425/217

[56] References Cited

U.S. PATENT DOCUMENTS 2,976,550 3/1961 Silver et al. ..... 209/664 X 3,329,263 7/1967 Rush et al. ..... 209/662

FOREIGN PATENT DOCUMENTS 619047 10/1933 Fed. Rep. of Germany ..... 209/670

*Primary Examiner*—Allen N. Knowles

*Attorney, Agent, or Firm*—George E. Kersey

[57] ABSTRACT

Method and apparatus for the segregation of molded parts by the use of a coil conveyor. The coil advantageously surrounds an interior cylinder to facilitate the segregation of comparatively small parts. The coil is supported solely at its hub end and moves flexibly with respect to at least one fixed side baffle.

9 Claims, 9 Drawing Figures

SEGREGATION OF MOLDED PARTS

BACKGROUND OF THE INVENTION

This invention relates to the segregation of molded parts, and, more particularly, to the segregation of molded production parts from accompanying by-product parts that are formed in the molding process.

In the production of parts by molding, molten material is forced into the cavities of a mold through opeings called sprues and channels called runners. When the material has cooled sufficiently, the mold is opened and the desired product is expelled, along with the by-product formed in the runner and sprue. The latter is waste which must be segregated from the production parts. This can be done manually, but that is time consuming and inefficient.

To curtail the extent of the manual effort, a number of techniques have been devised for the automated segregation of the desired mold product from the undesired product. A machine for one such technique is disclosed in U.S. Pat. No. 3,663,142 which issued May 16, 1972. The machine makes use of a conveyor belt which feeds the entire product from the mold to a "separator" or segregator in the form of coaxial disks on a shaft at the end of, and perpendicular to, the feed axis of the conveyor belt. The disks are spaced so that the desired product will fall between them and be collected, but the by-product will not. It is instead conveyed by scalloped or serrated peripheries of the disks to a waste collection station. In this arrangement, it is also desirable to have a second set of disks which are interposed with respect to the first set of disks.

At a variant of the disk system, a drum with flexible lift pins is substituted for the disks. The spacing of the pins is in accordance with the spacing of the disks, so that the desired objects fall between the pins, while the waste product is carried by the pins to a collection position.

While both the disk and drum systems are a considerable improvement over manual segregation, they require a belt conveyor and separate drives for the conveyor and the segregator.

Furthermore, the disks, the drum, the belt conveyor, and the requirement of two separate drives add to the mechanical complexity.

In addition, when fine filaments are produced during molding they can get caught on the disks, the hub of the disks and the pins of the drum. When this happens, they cause interference with the desired segregation of wanted and unwanted parts.

Moreover, while the drum and disk arrangements work well when there is a sufficient differentiation between the wanted and unwanted parts, they are not always suitable when the parts are small.

Finally, when the mold is changed, it is often necessary to change the segregator. However, the disks and drum segregators are not as easily changed as the mold, causing delays when production is switched from one product to another.

Accordingly, it is an object of the invention to facilitate the segregation of molded parts. A related object is to facilitate the segregation of wanted and unwanted parts. Another related object is to facilitate the segregation of production parts from the sprue and runner parts produced during molding.

Another object is to achieve the automated segregation of molded parts without the need for a conveyor belt. A related object is to realize automated segregation without the need for separate conveyor and segregator drive units.

A further object is to achieve automated segregation of molded parts without employing either disk or drum segregators. A related object is to reduce any tendency for filaments formed during molding to cause interference in the segregation of molded parts.

Yet another object is to facilitate the interchange of segregators when required by virtue of a change in production molds. Still another object is to facilitate the segregation of comparatively small parts.

SUMMARY OF THE INVENTION

In accomplishing the foregoing and related objects, the invention provides for the segregation of objects such as molded parts or members by using a rotatable conveyor, with openings, to permit some of the members to be segregated by falling through the openings, while other members are segregated by being advanced by the conveyor in the direction of its axis of rotation to a collection station. The members that are segregated from one another are illustratively desired production parts and by-product parts formed during the molding process.

In accordance with one aspect of the invention, the rotatable conveyor is an open spiral which is advantageously in the form of a regular helix and is supported by a contacting baffle.

In accordance with another aspect of the invention, the helix is a coil with non-overlapping turns and is cantilever mounted for rotation about its longitudinal axis. The pitch of the helix exceeds the maximum width of one type of member, for example, the desired production part, and simultaneously is less than the minimum width of another type of member, for example, the undesired waste parts.

In accordance with a further aspect of the invention, a cylinder can be mounted within the coil. This makes a supporting baffle for the coil unnecessary and permits the segregation of comparatively small parts. In addition, since any baffle used with the coil is not needed for support it can be adjustable to provide flexibility in the segregation of parts.

In accordance with still other aspects of the invention, the coil is bayonet mounted for easy removability to facilitate the interchange of coils when a different pitch is required for proper segregation of parts; the coil is positioned directly below the output chute of the associated molding machine to eliminate the need for a belt conveyor and its associated drive motor; and baffles are provided to expedite the desired segregation of parts and to control the delivery position.

DESCRIPTION OF THE DRAWINGS

Other aspects of the invention will become apparent after considering several illustrative embodiments, taken in conjunction with the drawings, in which.

DETAILED DESCRIPTION

Figure 1:
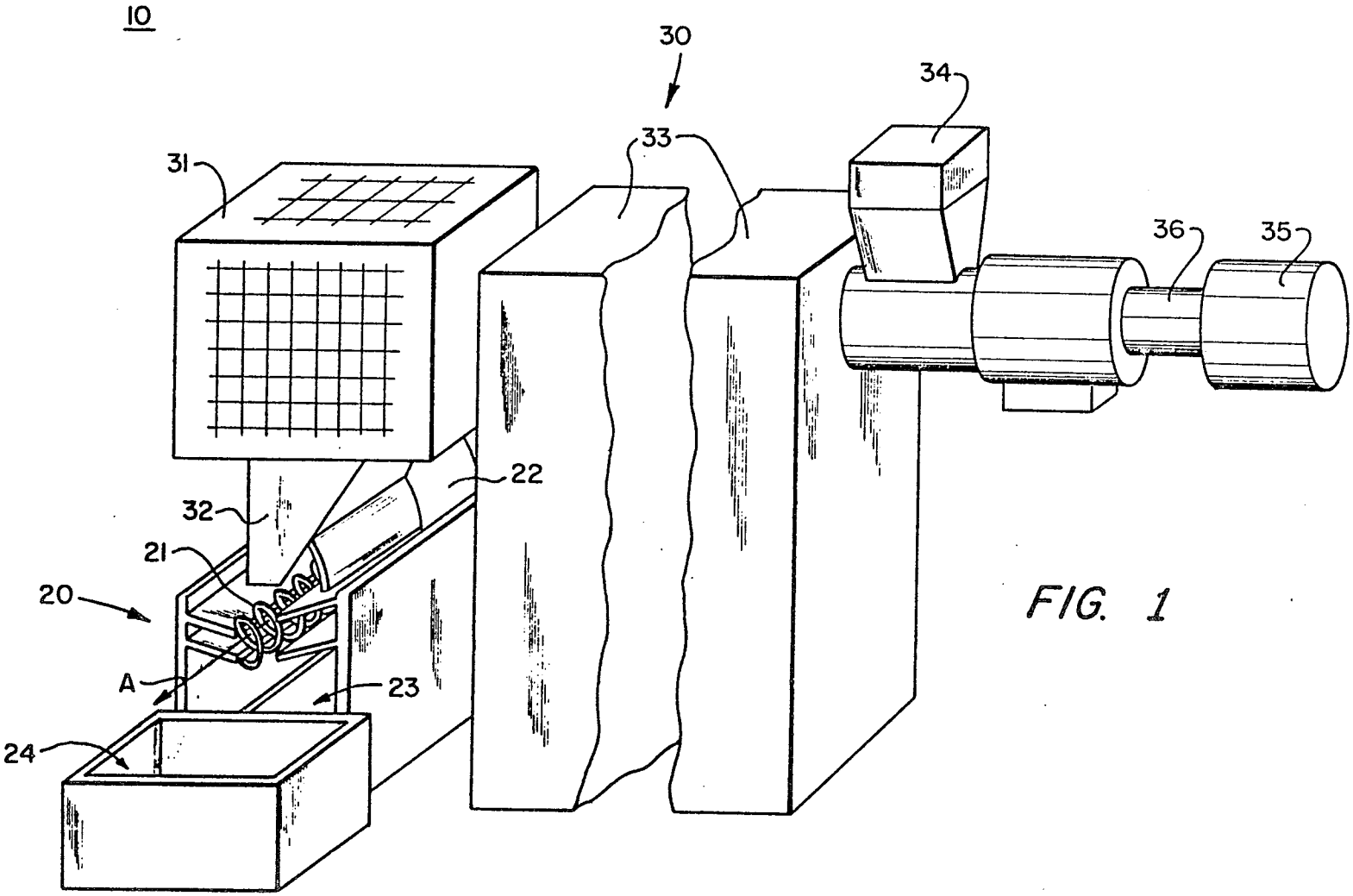
FIG. 1 is a perspective view of the system for practicing the invention.

Turning to the drawings, a perspective view of a system 10 for practicing the invention is shown in FIG. 1.

As indicated, a segregator unit 20 in accordance with the invention is employed in conjunction with a standard molding machine 30. The latter includes a mold (not visible in FIG. 1) within a protective cage 31, an output chute 32, a control panel 33, a hopper 34 for receiving the material to be molded (in pellet form), and a motor 35 for driving a injection screw (not visible in FIG. 1) within a barrel 36.

An illustrative molding machine 10 of the reciprocating screw injector type is the "Boy 15/5" unit manufactured by Boy Machines Inc. of Plainview, N.Y.

The segregator unit 20 is positioned directly beneath the output shute 32 of the machine 30. This eliminates the need for the kind of belt conveyor commonly found in the prior art segregator units.

A segregator unit 20 in accordance with the invention includes a spiral conveyor 21 in the form of a cantilever mounted coil which is driven by a motor 22. The spiral conveyor 21 receives molded parts directly from the chute 32. The desired production parts are guided through the open regions of the coil and are collected in a bin 23. The by-product parts are conveyed by the spiral motion of the coil in the direction indicated by the arrow A along the rotational axis, and are deposited in a bin 24. The by-product parts in the bin 24 are collected, manually or automatically by, for example, an auger mechanism (not shown), and are reground for use as pellet feed material for the hopper 34 on subsequent cycles.

Figure 2:
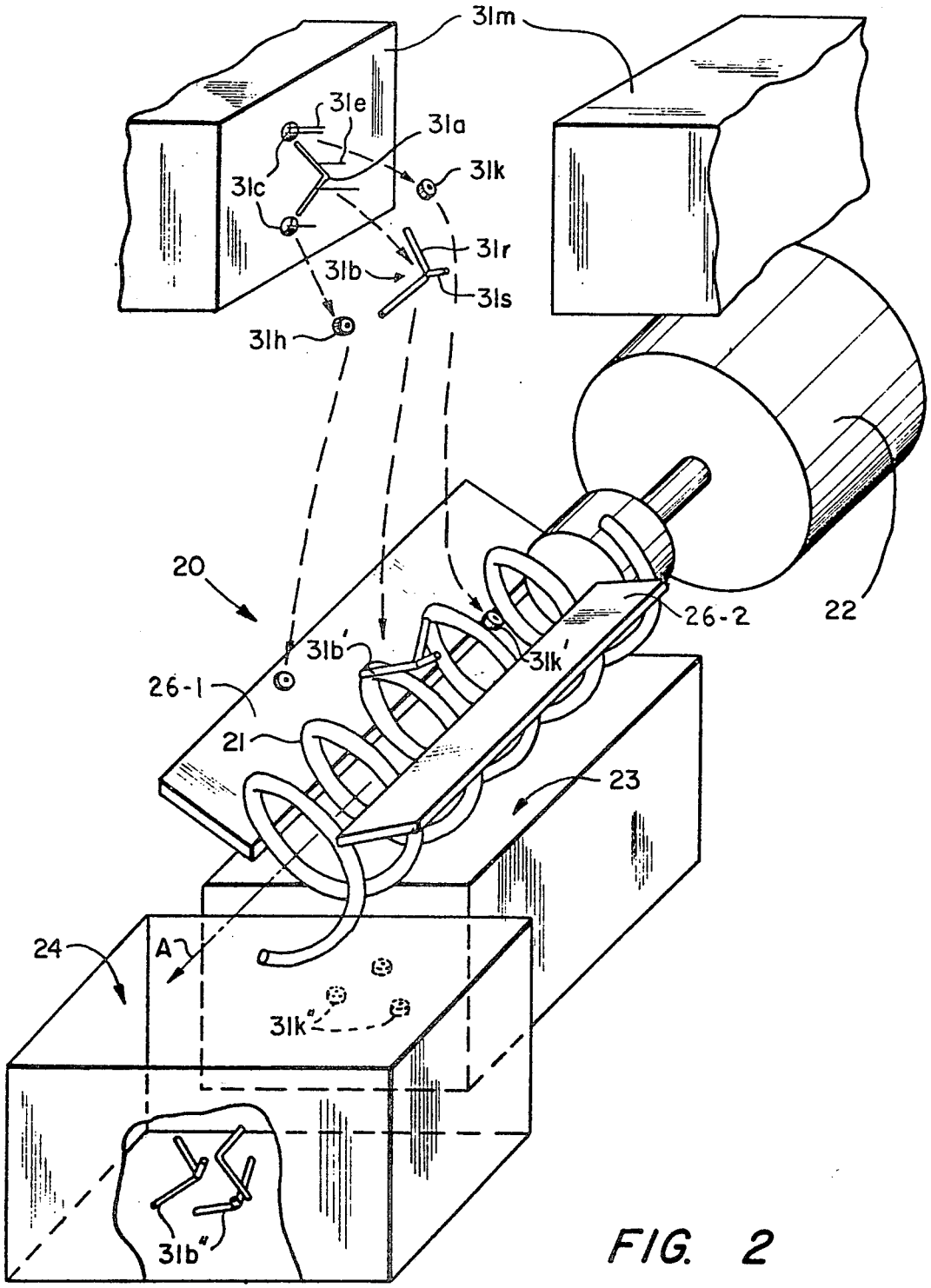
FIG. 2 is a perspective view of a portion of the system of FIG. 1 illustrating the practice of the invention.

The method of operation of the segregator unit 20 will be clear from the partial perspective view of FIG. 2.

During each operating cycle, after molten material has been injected into the cavity of the illustrative mold 31*m* and the material has solidified, the mold is separated as shown and ejector pins 31*e* force the molded product from the cavity 31*c*. The illustrative product is in the form of a wire clip 31*k*, together with a by-product 31*b* formed by a sprue 31*s* and a runner 31*r*. The sprue 31*s* results from the molten material that flows into the sprue opening 31*a*, while the runner 31*r* is the connecting link between the park 31*k* and the sprue 31*s*.

The desired production part 31*k* and the by-product part 31*b* are connected in the cavity 31*c*, but become disconnected when the parts are ejected from the mold.

After ejection, the parts 31*k* and 31*b* fall into the chute 32 (not shown in FIG. 2) and onto the spiral conveyor 21. The latter is in contact with side baffles 26-1 and 26-2. The contact of the coil 21 with the baffles provides stability to the embodiment of FIG. 2. Since the coil 21 is cantilever mounted on the shaft of the drive motor 22, the coil would tend to wobble if there were no contact baffling. It is to be noted that there is not adverse effect from the contact, since the flexibility of the coil allows it to adjust the operating circumstances without interfering with the segregation function. This is by contrast, for example, with the undesired wear and frictional effects that would be present if a baffle were to be placed in direct contact with an auger feed screw.

For illustration, FIG. 2 shows parts 31*k*′ and 31*b*′, which were produced during a prior cycle, in the course of being segregated in accordance with the invention. The desired, and smaller, production part 31*k*′ falls between the opening of the coil 21 into the collection bin 23, which is shown with parts 31*k*″ from prior cycles of operation. The relatively larger by-product part 31*b*′ is advanced by the spiral motion of the rotating coil 21 in the direction of the axial arrow A into the by-product collection bin 24, which is shown with by-product parts 31*b*″ from prior cycles.

Figure 3A:
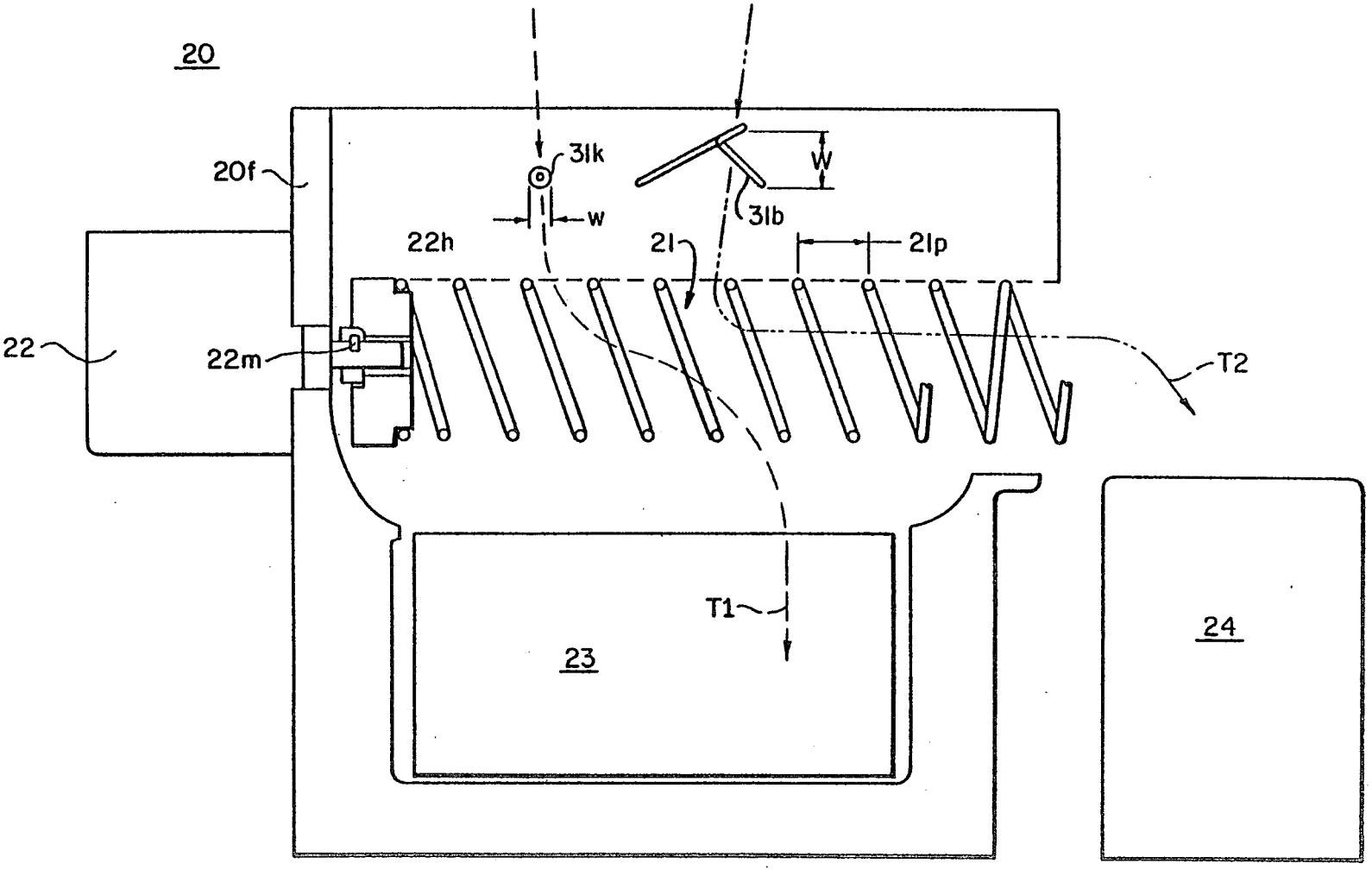
FIG. 3A is a sectional view of the segregator in the system of FIG. 1.

Details of the segregator unit 20 are shown in the cross-sectional view of FIG. 3A. The segregator unit 20 is in a frame 20*f* that mounts the drive motor 22. The hub 22*h* of the drive motor 22 has a bayonet mount 22*m* for the conveyor coil 21. This permits easy interchange of the coil 21 with a coil of different pitch when needed because of a change in molds.

The coil 21 is a regular helix with a pitch 21*p* that is greater than the maximum width w of the desired part 31*k*, and simultaneously less than at least one dimension W, and desirably less than all width dimensions of the by-product part 31*b*.

As a result, the part 31*k* eventually falls into the collection bin 23, taking, for example, the trajectory T1 because of the rotational effect of the coil 21, but eventually falling through the gap between the adjoining turns of the coil into the bin 23.

The by-product part 31*b* does not fall through the coil 21 and is illustratively advanced along the trajectory T2 into the by-product collection bin 24 at the free end of the coil.

Figure 3B:
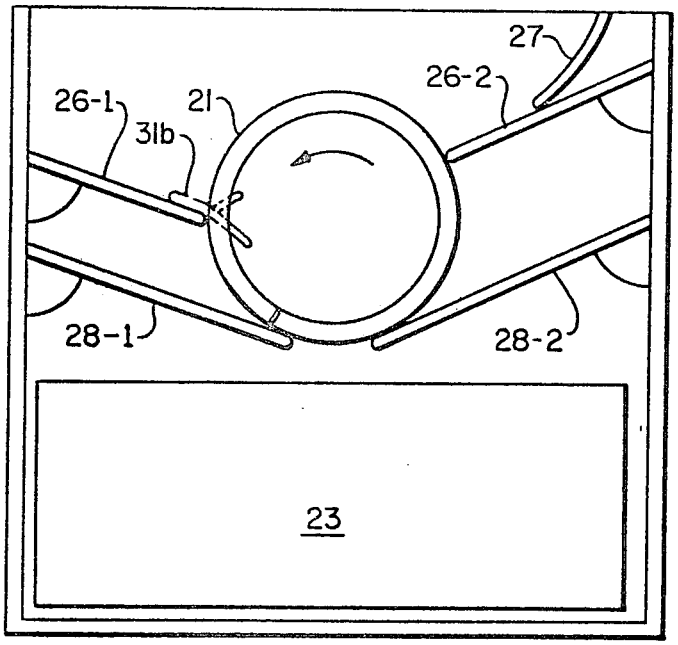
FIG. 3B is a frontal view of the segregator in the system of FIG. 1.

As can be seen from the end view of FIG. 3B, the by-product part 31*b* may be caught between the coil and one of the side baffles 26-1 or 26-2. In addition a shield 27 is mounted above the baffle 26-2 when the rotation of the coil 21 is such that there is a tendency for some of the by-product parts to be thrown upwardly from the coil during the spiraling motion. The baffles 26-1 and 26-2 are positionally adjustable, with the first baffle 26-1 being initially positioned with its tip in contact with the coil 21 at about the axis of symmetry, and the second baffle 26-2 having its tip above the axis of symmetry.

Also as indicated in FIG. 3B, auxiliary baffles 28-1 and 28-2 are advantageously employed, with their tips near the lower position of the coil 21.

Figure 3C:
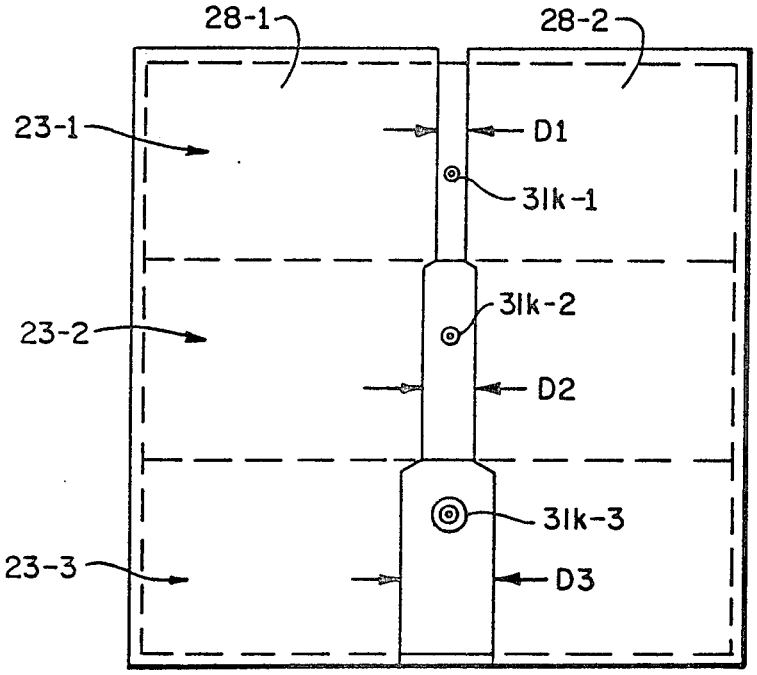
FIG. 3C is a bottom view of the segregator in the system of FIG. 1.

Besides acting as deflectors for the production parts 31*k*, the lower baffles 28-1 and 28-2 can be proportioned as shown in the alternative embodiment of FIG. 3C with graduated widths, for example D1, D2, and D3, to provide a further segregation of different sized production parts into subcompartments of the bin 23, for example 23-1, 23-2 and 23-3 for parts 31*k*-1, 31*k*-2 and 31*k*-3 of three different sizes.

Figure 4A:
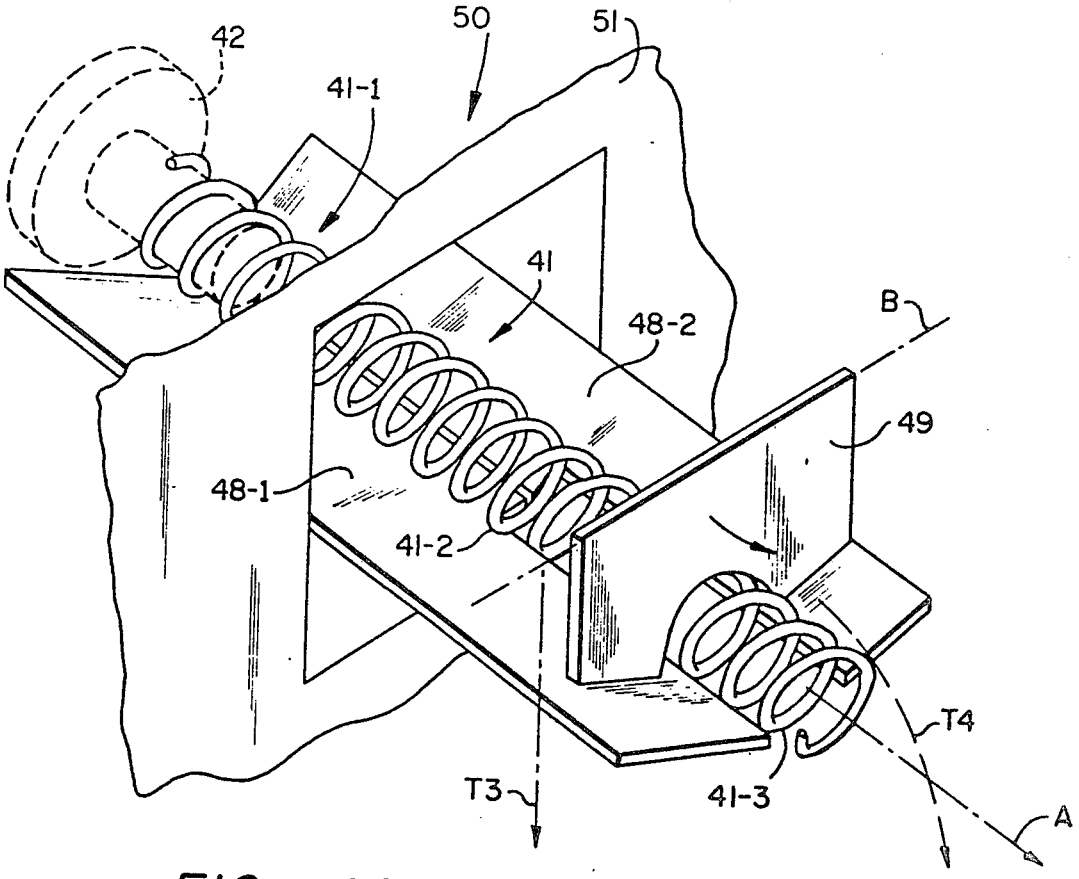
FIG. 4A is a perspective view of a further alternative segregator.

A coil conveyor in accordance with the invention may also be used for transporting objects from the interior of a machine for segregation outside of the machine as indicated in FIG. 4A.

The coil 41 of FIG. 4A extends into a production machine 50 through a side panel 51, and is illustratively driven by a motor 42 (shown in phantom) mounted on an opposite side panel (not shown). This is by contrast with the coil 21 in FIG. 1 which is positioned beneath the output chute 32 of a machine 30.

The objects to be segregated are released within the machine 50 on the interior portion 41-1 of the coil 41. Unlike the baffles 28-1 and 28-2 of FIG. 3B, the baffles 48-1 and 48-2 of FIG. 4A have their tips 48*t* in contact or in close proximity within the machine 50, as can be more clearly seen in the plan view of FIG. 4B.

Consequently, the desired production parts are held by the baffles 48-1 and 48-2 and advanced in the direction of the axis of rotation A by the coil 41.

Figure 4B:
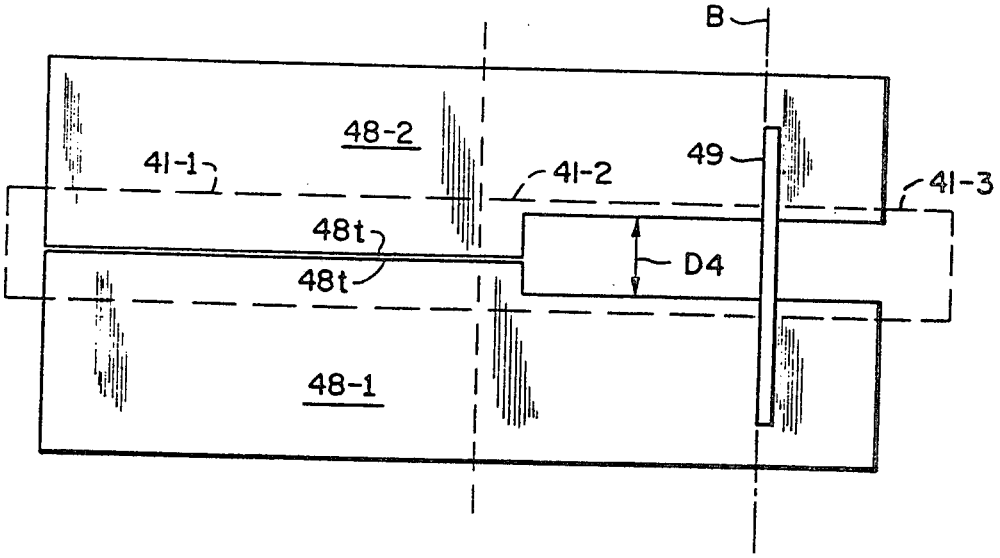
FIG. 4B is a plan view of the segregator of FIG. 4A.

Just beyond where the baffles 48-1 and 48-2 leave the machine 50 at the side panel 51, they are spaced apart by a distance D4 as indicated in FIG. 4B. Accordingly, the production parts are able to drop into a collection bin (not shown) as represented by a trajectory T3.

The embodiment of FIG. 4A also includes a frontal baffle 49 which is pivotable about an axis B that is perpendicular to the axis of rotation A. Occasionally some of the production parts become entangled with, and are carried by, the by-product parts. The baffle 49 serves to jog the production parts from any entanglements, allowing them to fall into their collection bin. The by-product parts then pass from the intermediate region 41-2 of the coil and pass over the free end 41-3 into their own collection bin, for example along the trajectory T4.

Figure 5A:
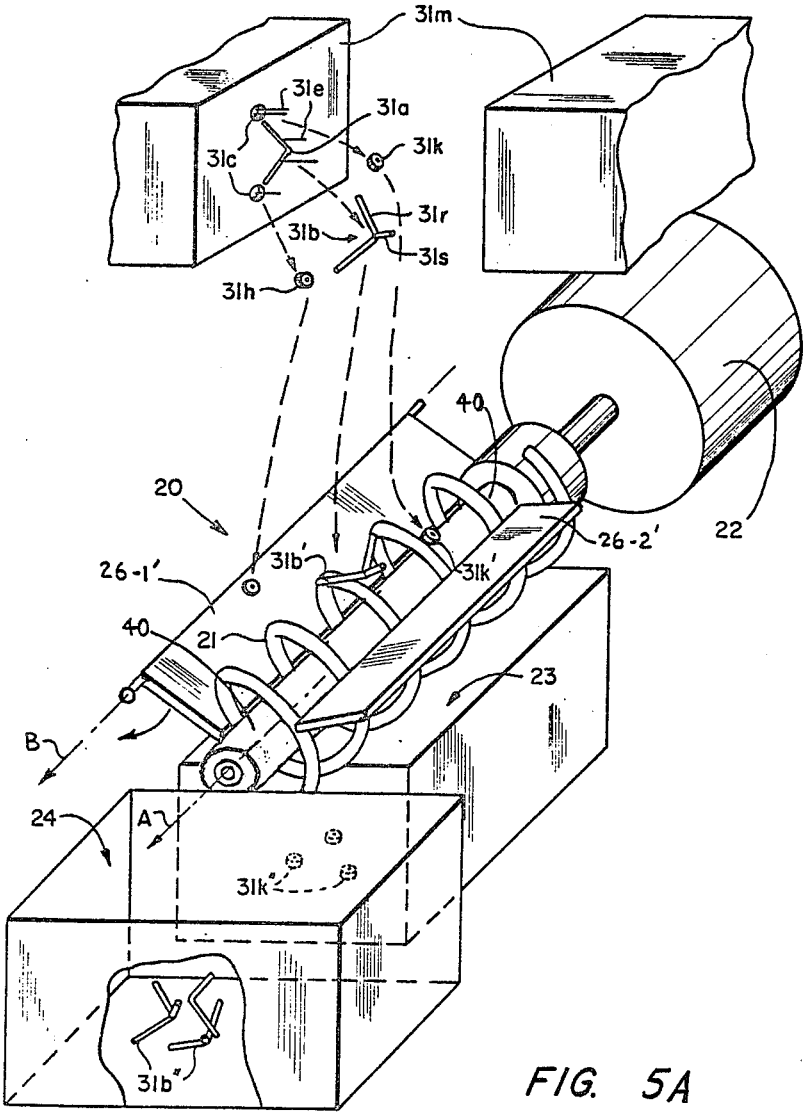
FIG. 5A is a perspective view of another system for practicing the invention.
Figure 5B:
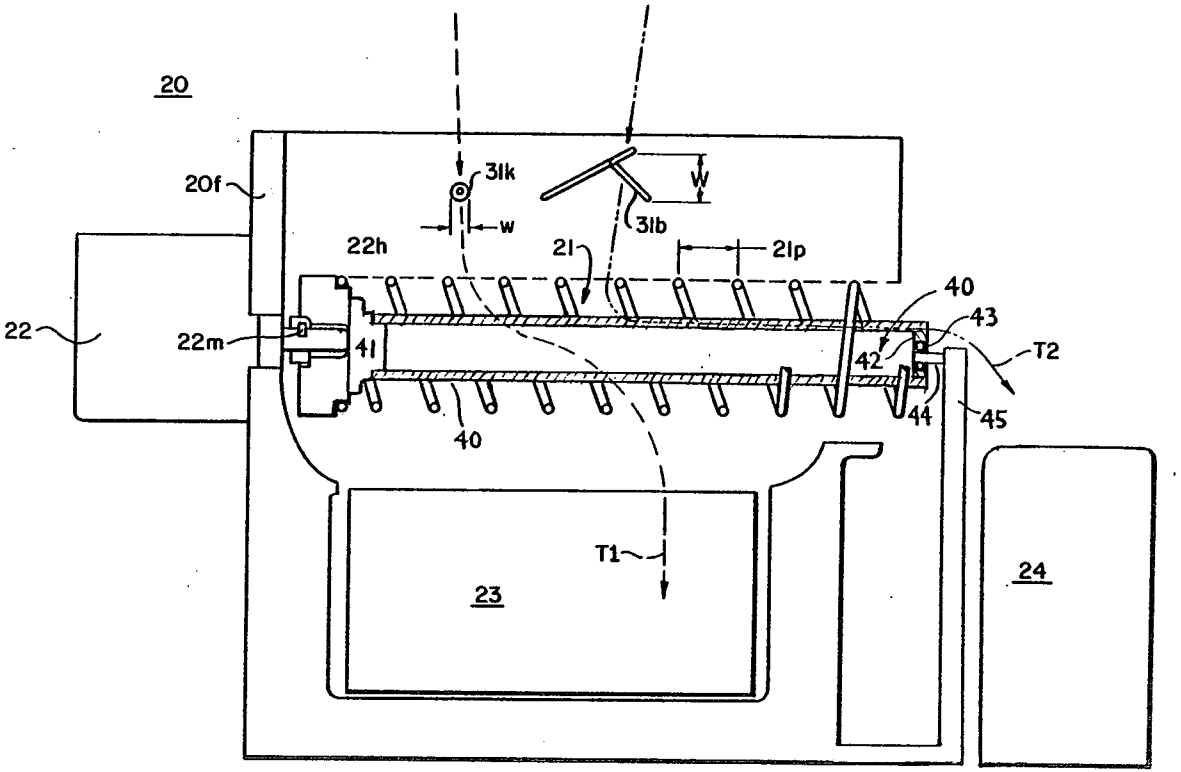
FIG. 5B is a sectional view of the segregator in the system of FIG. 5A.

A modified implementation of the invention is shown in FIGS. 5A and 5B where the coil 21 envelopes an interior cylinder 40. As can be seen in FIG. 5B the cylinder 40 is removably mounted on an extension 41 of the hub for the coil 21. In addition, at least one of the side baffles 26-1 and 26-2 can be axially adjustable. For example the baffle 26-1' is rotatable about the longitudinal axis B. When the side baffles 26-1' and 26-2' are in contact or near the coil 21, the size of the parts collected in the bin 23 is determined by the spacing of the outside diameter of the cylinder to from the inside diameter of the coil 21. Further facility in segregating is achieved by outwardly pivoting one or more of the side baffles, for example the baffle 26-1', to provide a desired spacing between the end of the baffle and the coil according to the segregation that is desired.

In the case of the embodiment of FIGS. 5A and 5B, the cylindrical core 40 provides the desired stability without the need for baffle-coil contact. When the outside diameter of the cylinder 40 is about the same as the inside diameter of the coil 21, separation can be effected for parts having at least one dimension on the order of the coil wire diameter. In this case the rounded contact of the coil with the cylinder helps prevent inadvertent damage to the parts being segregated.

For the particular embodiment of FIGS. 5A and 5B the cylinder 40 rotates with the mount 22*m*, and the opposite end of the cylinder has a cap 42 with a bearing 43 journalled about an axle 44 projecting from a support 45. It will be appreciated that the cylinder 40 may be free wheeling, or separately driven, for example, when a bearing configuration like that at the axle 44 is used with the mount 22*m*.

While various aspects of the invention have been illustrated by the foregoing detailed embodiments, it will be understood that various substitutions of equivalents may be made without departing from the spirit and scope of the invention as set forth in the appended claims.

What is claimed is:

1. The method of segregating molded production parts from unwanted byproduct parts, comprising the steps of:

(a) depositing the parts above and upon a flexible rotatable open spiral which is supported solely at a hub end, said spiral containing a fixedly positioned interior cylinder extending from said hub;

(b) positioning a fixed baffle alongside said open spiral extending in the direction of the axis of rotation of the spiral which is able to move flexibly with respect to both said interior cylinder and said baffle;

thereby to permit the byproduct parts to pass through the openings in said spiral while the production parts are advanced in the direction of the axis of rotation of the spiral.

2. The method of claim 1 wherein said open spiral is a regular helix.

3. The method of claim 2 wherein said regular helix is a coil with non-overlapping turns and is rotatable about its longitudinal axis.

4. The method of claim 3 wherein said coil has a pitch which exceeds the maximum width of one type of object and is less than at least one width dimension of another type of object.

5. The method of claim 1 wherein said rotatable spiral is cantilever mounted.

6. The method of claim 1 wherein said rotatable spiral is bayonet mounted for easy removability.

7. The method of claim 1 wherein said rotatable spiral is positioned directly below the output chute of a machine.

8. The method of claim 1 wherein said rotatable spiral has at least one baffle.

9. The method of claim 8 wherein side baffles in contact with one another are positioned below said spiral to advance objects to a prescribed position.

* * * * *